US009506680B2

(12) United States Patent
Jeong et al.

(10) Patent No.: US 9,506,680 B2
(45) Date of Patent: Nov. 29, 2016

(54) ICE MAKING APPARATUS AND REFRIGERATOR HAVING THE SAME

(75) Inventors: Jin Jeong, Gyeonggi-do (KR); Do Hyung Kim, Gyeonggi-do (KR); Sang Hyun Park, Gyeonggi-do (KR); Yong Sung Yoon, Gyeonggi-do (KR); Qasim Sarwar Khan, Gyeonggi-do (KR); Seung Ah Joo, Gyeonggi-do (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1197 days.

(21) Appl. No.: 13/458,182

(22) Filed: Apr. 27, 2012

(65) Prior Publication Data

US 2012/0279240 A1 Nov. 8, 2012

(30) Foreign Application Priority Data

May 3, 2011 (KR) ..... 10-2011-0042164

(51) Int. Cl.
*F25C 1/04* (2006.01)
*F25C 5/18* (2006.01)

(52) U.S. Cl.
CPC ..... *F25C 1/04* (2013.01); *F25C 5/187* (2013.01); *F25C 2700/02* (2013.01); *F25D 2317/061* (2013.01)

(58) Field of Classification Search
CPC F25C 5/187; F25C 2400/10; F25C 2700/02; F25C 2305/022; F25C 1/04; F25D 2317/061
USPC ..... 165/11.2
See application file for complete search history.

(56) References Cited

U.S. PATENT DOCUMENTS 2,104,845 A * 1/1938 Anderson ..... F25D 21/14 62/288
4,888,481 A * 12/1989 Kallin ..... G01D 5/34715 250/231.13
5,074,122 A * 12/1991 Babin ..... B61D 27/0018 165/41

(Continued)

FOREIGN PATENT DOCUMENTS

KR 10-2009-0109422 10/2009
KR 10-2009-0123338 12/2009

(Continued)

OTHER PUBLICATIONS

International Search Report issued Sep. 3, 2012 in corresponding International Patent Application No. PCT/KR2012/003334.

(Continued)

*Primary Examiner* — Len Tran
*Assistant Examiner* — Kun Kai Ma
(74) *Attorney, Agent, or Firm* — Staas & Halsey LLP

(57) ABSTRACT

Disclosed is an ice making apparatus and a refrigerator having the same. The refrigerator includes an ice making tray in which ice cubes are made, an ejector to discharge the ice cubes from the ice making tray, an ice bin to store the ice cubes discharged by the ejector, an auger to move the ice cubes in the ice bin, a first drive unit to provide the ejector with rotational force, a second drive unit to provide the auger with rotational force, an emitter to output optical signals so as to sense whether or not the ice cubes in the ice bin are at a full ice level, and a receiver to receive the optical signals output from the emitter, wherein any one of the emitter and the receiver is installed at the first drive unit, and the other one is installed at the second drive unit.

21 Claims, 10 Drawing Sheets

(56) References Cited

U.S. PATENT DOCUMENTS

| | | | | |
|---|---|---|---|---|
| 5,406,156 | A * | 4/1995 | Somers | H02K 5/04 310/89 |
| 5,743,599 | A * | 4/1998 | Henderson | H02P 3/06 303/152 |
| 6,015,274 | A * | 1/2000 | Bias | F04D 25/088 417/423.1 |
| 6,351,958 | B1 | 3/2002 | Pastryk et al. | |
| 8,164,748 | B1 * | 4/2012 | Flanders et al. | 356/300 |
| 8,393,164 | B2 * | 3/2013 | Kim et al. | 62/73 |
| 2003/0137210 | A1 * | 7/2003 | Southall | H01F 41/0266 310/232 |
| 2004/0079173 | A1 * | 4/2004 | Neely | H02P 6/10 73/862.333 |
| 2006/0262546 | A1 * | 11/2006 | Liang et al. | 362/376 |
| 2007/0058373 | A1 * | 3/2007 | Yoshimura et al. | 362/294 |
| 2008/0156000 | A1 * | 7/2008 | Shin et al. | 62/73 |
| 2009/0193824 | A1 * | 8/2009 | Heger et al. | 62/126 |
| 2009/0293510 | A1 * | 12/2009 | Kim | F25C 5/187 62/73 |
| 2010/0052457 | A1 * | 3/2010 | Brahmavar | H02K 1/2733 310/156.13 |
| 2010/0199701 | A1 * | 8/2010 | Yoon | F25C 5/007 62/344 |
| 2010/0319373 | A1 * | 12/2010 | Jeong et al. | 62/137 |
| 2011/0100039 | A1 * | 5/2011 | Kim et al. | 62/139 |

FOREIGN PATENT DOCUMENTS

| | | |
|---|---|---|
| KR | 10-2010-0062187 | 6/2010 |
| KR | 10-2010-0094880 | 8/2010 |
| KR | 10-2010-0119285 | 11/2010 |

OTHER PUBLICATIONS

Korean Notice of Allowance dated Feb. 24, 2015 from Korean Patent Application No. 10-2011-0042164, 6 pages.

Russian Decision on Grant dated Jan. 12, 2015 from Russian Patent Application No. 2013148932, 12 pages.

Mexican Office Action dated Jun. 23, 2016 from Mexican Patent Application No. MX/a/2013/012794, and related document from Mexican law firm of Dumont Bergman Bider, 6 pages in total.

* cited by examiner

ICE MAKING APPARATUS AND REFRIGERATOR HAVING THE SAME

CROSS-REFERENCE TO RELATED APPLICATIONS

This application claims the benefit of Korean Patent Application No. 10-2011-0042164 filed on May 3, 2011 in the Korean Intellectual Property Office, the disclosure of which is incorporated herein by reference.

BACKGROUND

1. Field

Embodiments of the present disclosure relate to a refrigerator including an optical sensor to sense whether or not ice cubes stored in an ice bin are at a full ice level.

2. Description of the Related Art

In general, a refrigerator refers to an apparatus which preserves food in a cool state using a refrigeration cycle comprised of a compressor, a condenser, an expansion valve, and an evaporator, and also includes an ice making apparatus to make ice cubes.

The ice making apparatus includes an ice making tray in which ice cubes are made, an ejector to discharge the ice cubes from the ice making tray, an ice bin to store the ice cubes discharged from the ice making tray, and a controller to control an ice making process, thereby automatically making ice cubes.

In this case, the ice making apparatus further includes an ice level sensing member to sense whether the ice bin is fully filled with ice cubes and to determine whether additional ice cubes need to be made or not. An optical sensor is used as the ice level sensing member, and the optical sensor has an emitter to output optical signals and a receiver to receive the optical signals.

However, the refrigerator, which generally uses the optical sensor as the ice level sensing member, further includes an optical sensor heater so as to prevent malfunction of the optical sensor due to fog and frost generated around the optical sensor.

SUMMARY

Therefore, it is an aspect of the present invention to provide a refrigerator having an improved structure so as not to require a conventional optical sensor heater for prevention of fog while using an optical sensor to sense an ice level of an ice bin.

Additional aspects of the invention will be set forth in part in the description which follows and, in part, will be apparent from the description, or may be learned by practice of the invention.

In accordance with one aspect of the present invention, a refrigerator includes an ice making tray in which ice cubes are made, an ejector to discharge the ice cubes from the ice making tray, an ice bin to store the ice cubes discharged by the ejector, an auger to move the ice cubes in the ice bin, a first drive unit to provide the ejector with rotational force, a second drive unit to provide the auger with rotational force, an emitter to output optical signals so as to sense whether or not the ice cubes in the ice bin are at a full ice level, and a receiver to receive the optical signals output from the emitter, wherein any one of the emitter and the receiver is installed at the first drive unit, and the other one is installed at the second drive unit.

The first drive unit may be arranged forward of the ice making tray, and the second drive unit may be arranged rearward of the ice bin.

Any one of the emitter and the receiver may be installed at a rear lower portion of the first drive unit, and the other one may be installed at a front upper portion of the second drive unit.

The first drive unit may include a first motor to generate rotational force, a first housing to accommodate the first motor, and a first optical sensor receiving portion arranged on an inner surface of the first housing to install the emitter or the receiver.

The first drive unit may further include a controller which is accommodated at the first housing to control ice making processes.

The first housing may be formed, at one surface thereof, with an opening portion so that the emitter or the receiver installed at the first optical sensor receiving portion is exposed to the outside.

The first optical sensor receiving portion may include a first socket portion which protrudes from an inner side surface of the first housing and a first optical sensor receiving space formed within the first socket portion.

The first optical sensor receiving portion may further include protrusions which protrude from opposite inner side surfaces of the first socket portion to support the emitter or the receiver.

The second drive unit may include a second motor to generate rotational force, a second housing to accommodate the second motor, and a second optical sensor receiving portion arranged on a surface of the second housing to install the emitter or the receiver.

The second optical sensor receiving portion may include a second socket portion which protrudes from an outer side surface of the second housing and a second optical sensor receiving space formed within the second socket portion.

The refrigerator may further include a blast fan to define a circulation passage of cold air in an ice making chamber, wherein the emitter and the receiver may be positioned on the circulation passage.

The refrigerator may further include a frost depositing member provided at the ice making chamber so as to induce frost deposition on the frost depositing member itself.

The refrigerator may further include a refrigerant pipe to allow at least a portion thereof to come into contact with the ice making tray in order to supply the ice making chamber with cold air, wherein the frost depositing member may include heat exchange ribs which protrude from a lower portion of the ice making tray.

The frost depositing member may include a heat exchanger provided at the ice making chamber to supply the ice making chamber with cold air.

The frost depositing member may include frost depositing plates provided at the ice making chamber.

The refrigerator may further include a main body, a storage chamber provided within the main body while being opened at a front face thereof, and an ice making chamber provided within the storage chamber.

In accordance with another aspect of the present invention, a refrigerator having a storage chamber, an ice making chamber provided within the storage chamber, an ice making tray in which ice cubes are made, an ice bin to store the ice cubes discharged from the ice making tray, and an optical sensor to sense whether or not the ice cubes in the ice bin are at a full ice level, wherein the optical sensor includes an emitter to output optical signals and a receiver to receive the optical signals output from the emitter, and the emitter and the receiver are installed at a high temperature part having a relatively high temperature in the ice making chamber.

The high temperature part may include a first drive unit to discharge the ice cubes into the ice bin.

The first drive unit may include a controller to control ice making processes.

The high temperature part may include a second drive unit to move the ice cubes in the ice bin.

The ice making chamber may be formed with a circulation passage of cold air, and the emitter and the receiver may be positioned on the circulation passage.

The refrigerator may further include a frost depositing member provided at the ice making chamber so as to induce frost deposition on the frost depositing member itself.

In accordance with another aspect of the present invention, a refrigerator includes an ice making tray in which ice cubes are made, an ejector to discharge the ice cubes from the ice making tray, an ice bin to store the ice cubes supplied from the ice making tray, an auger to move the ice cubes in the ice bin, a first drive unit mounted at one side in a longitudinal direction of the ice making tray so as to drive the ejector, a second drive unit mounted at one side in a longitudinal direction of the ice bin while being mounted to be disposed at an opposite side of the first drive unit so as to drive the auger, an emitter to output optical signals so as to sense whether or not the ice cubes in the ice bin are at a full ice level, and a receiver to receive the optical signals output from the emitter, wherein any one of the emitter and the receiver is installed at a lower end of the first drive unit, and the other one is installed at an upper end of the second drive unit.

The emitter and the receiver may be installed to face each other.

The emitter and the receiver may be installed in a diagonal direction to enlarge a sensing range.

In accordance with a further aspect of the present invention, an ice making apparatus may include an ice making tray in which ice cubes are made, an ice bin to store the ice cubes discharged from the ice making tray, a first drive unit which provides rotational force to discharge the ice cubes from the ice making tray, a second drive unit which provides rotational force to move the ice cubes in the ice bin, and an optical sensor to sense whether or not the ice cubes in the ice bin are at a full ice level, wherein the optical sensor includes an emitter to output optical signals and a receiver to receive the optical signals output from the emitter, and any one of the emitter and the receiver is installed at the first drive unit, and the other one is installed at the second drive unit.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
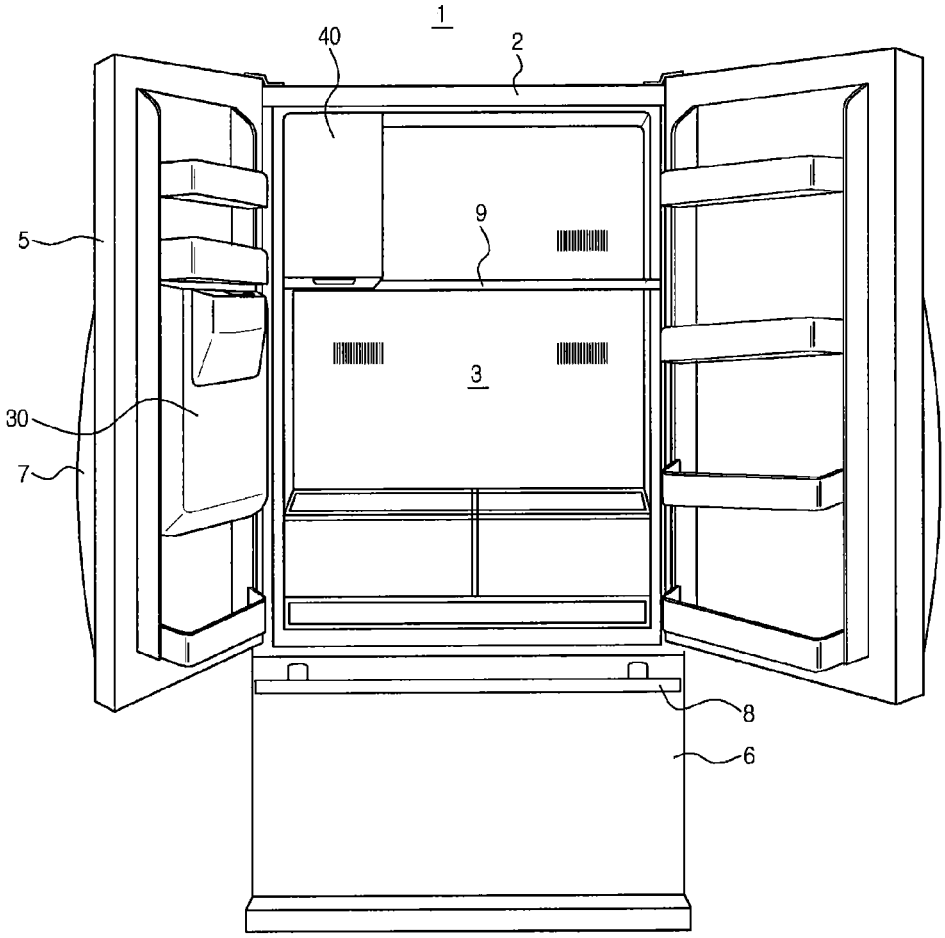
FIG. 1 is a front view illustrating a refrigerator according to an exemplary embodiment of the present invention.

Reference will now be made in detail to the embodiments of the present invention, examples of which are illustrated in the accompanying drawings, wherein like reference numerals refer to like elements throughout.

Figure 2:
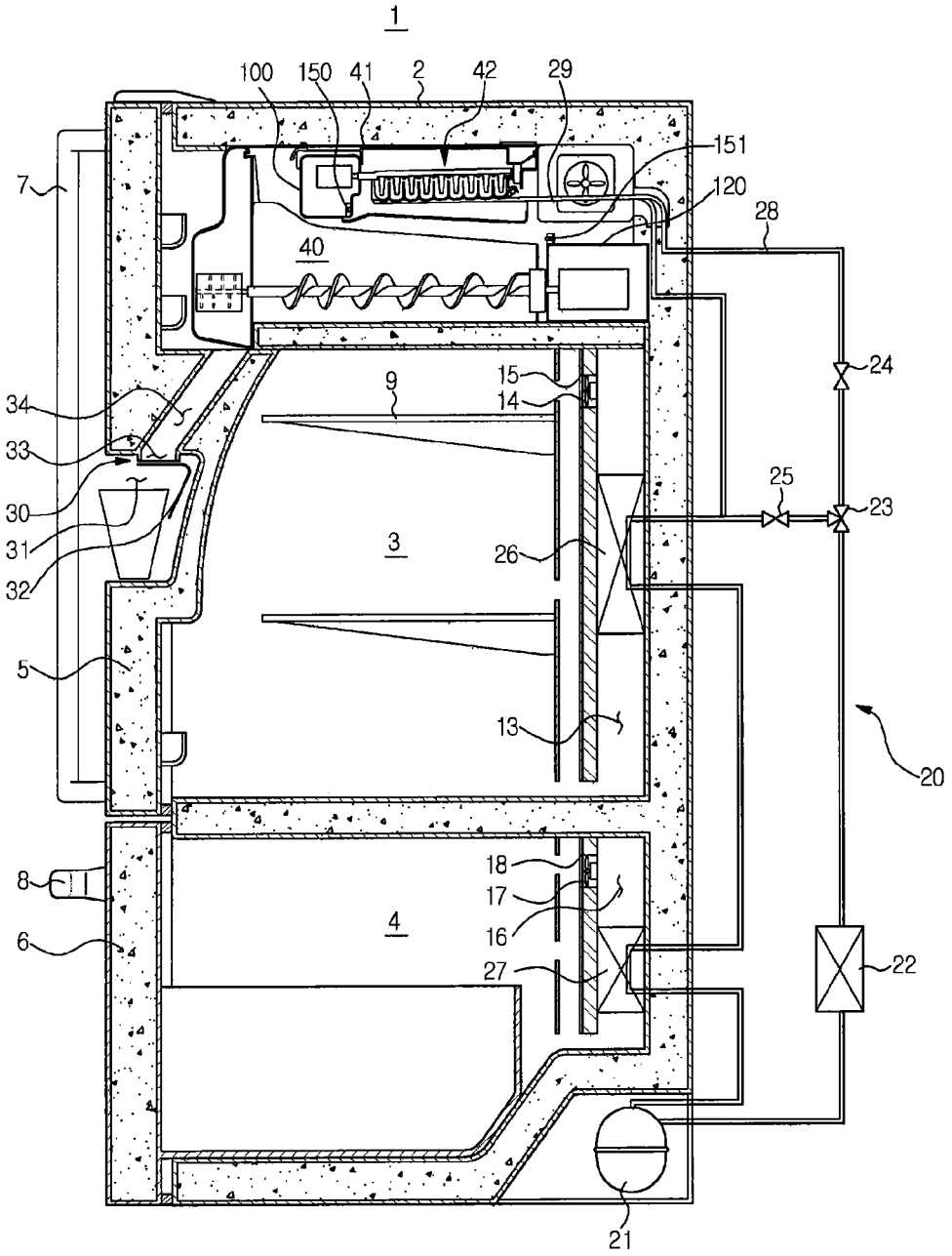
FIG. 2 is a sectional view illustrating the refrigerator shown in FIG. 1.

FIG. 1 is a front view illustrating a refrigerator according to an exemplary embodiment of the present invention. FIG. 2 is a sectional view illustrating the refrigerator shown in FIG. 1.

Hereinafter, the exemplary embodiment of the present invention will be described with reference to FIGS. 1 and 2. For reference, the refrigerator, which is designated by reference numeral 1, according to the exemplary embodiment of the present invention refers to a so-called French door type refrigerator (FDR) provided, at an upper portion thereof, with a refrigerating chamber which is opened and closed by a pair of doors while being provided, at a lower portion thereof, with a drawer type freezing chamber. However, it should be understood that the technical idea of the present invention is not limited to the French door type refrigerator, but may also be applied to various types of refrigerators such as a side-by-side type refrigerator, a bottom mounted freezer (BMF) type refrigerator, a top mounted freezer (TMF) type refrigerator, a four-door type refrigerator, etc.

The refrigerator 1 includes a main body 2, storage chambers 3 and 4 provided in the main body 2, doors 5 and 6 to open and close the storage chambers 3 and 4, respectively, an ice making chamber 40, an ice making apparatus 42 provided at the ice making chamber 40, a refrigeration cycle 20 to supply cold air, and a dispenser 30 to take out ice cubes to the outside without opening each of the doors 5 or 6.

The storage chambers 3 and 4 are divided into upper and lower chambers by a horizontal partition wall so that the main body 2 is provided, at an upper portion thereof, with a refrigerating chamber 3 while being provided, at a lower portion thereof, with a freezing chamber 4.

The refrigerating chamber 3 may be provided with at least one shelf 9 on which food is placed.

The doors 5 and 6 are comprised of a pair of refrigerating chamber doors 5 and a freezing chamber door 6, respectively, and the refrigerating chamber doors 5 open and close a front face of the refrigerating chamber 3. The refrigerating chamber doors 5 are hinged-coupled at opposite sides of the main body 2 so as to be able to pivot forward, respectively. Each of the refrigerating chamber doors 5 may be provided, at a front surface thereof, with a refrigerating chamber door handle 7 which lengthily extends in up and down directions to open and close the refrigerating door 5.

The freezing chamber door 6 is provided as a drawer type, and is mounted at the main body 2 so as to be retractable and withdrawable in a sliding manner. The freezing chamber door 6 is provided, at a front surface thereof, with a freezing chamber door handle 8 to open and close the freezing chamber door 6.

Meanwhile, the refrigerating chamber 3 is provided, at one side of an upper portion thereof, with the ice making chamber 40 divided by an ice making chamber case 41. The ice making apparatus 42 is arranged at the ice making chamber 40 to make ice cubes.

The ice making apparatus 42 includes a first drive unit 100, a second drive unit 120, an emitter 150 to output optical signals in order to sense an ice level, and a receiver 151 to receive the optical signals, and this will be described in detail below.

Here, the emitter 150 may be installed at the first drive unit 100, whereas the receiver 151 may be installed at the second drive unit 120.

The refrigeration cycle 20 is constituted to independently supply refrigerant to each of the refrigerating chamber 3, the freezing chamber 4, and the ice making chamber 40. The main body 2 is provided, at one side of a lower portion thereof, with a compressor 21 to compress refrigerant while being provided, at a rear face thereof, with a condenser 22 to condense the compressed refrigerant. The condensed refrigerant in the condenser 22 may flow through a passage selectively switched by a switching valve 23.

When the passage is directed toward a second expansion valve 25, refrigerant expanded through the second expansion valve 25 sequentially passes through a refrigerating chamber evaporator 26 and a freezing chamber evaporator 27 so as to be supplied to each of the refrigerating chamber 3 and the freezing chamber 4.

Cold air generated by the refrigerating chamber evaporator 26 is supplied to the refrigerating chamber 3 through a refrigerating chamber cold air supply duct 13. The cold air of the refrigerating chamber cold air supply duct 13 is blown into the refrigerating chamber 3 through a refrigerating chamber cold air outlet 15 by a refrigerating chamber fan 14.

On the other hand, cold air generated by the freezing chamber evaporator 27 is supplied to the freezing chamber 4 through a freezing chamber cold air supply duct 16. The cold air of the freezing chamber cold air supply duct 16 is blown into the freezing chamber 4 through a freezing chamber cold air outlet 18 by a freezing chamber fan 17.

Meanwhile, when the passage is directed toward a first expansion valve 24, refrigerant expanded through the first expansion valve 24 is guided and supplied to the ice making chamber 40, and is then guided to the refrigerating chamber evaporator 26 and the freezing chamber evaporator 27 again.

Here, a refrigerant pipe 28 to supply refrigerant is comprised, at a portion thereof, of an ice making refrigerant pipe 29 which passes via the inside of the ice making chamber 40. The ice making refrigerant pipe 29 comes into contact with a lower portion of an ice making tray 50 to directly cool the ice making tray 50.

The dispenser 30 includes a take-out space 31 formed so that a corresponding one of the refrigerating chamber doors 5 is recessed at a portion of the front surface thereof, a discharge path 34 to guide ice cubes from the ice making chamber 40 to the take-out space 31, a take-out outlet 33 formed at an exit of the discharge path 34, and an opening and closing member 32 to open and close the take-out outlet 33.

Accordingly, a user may easily take out ice cubes made by the ice making apparatus 42 without opening the doors 5.

Figure 3:
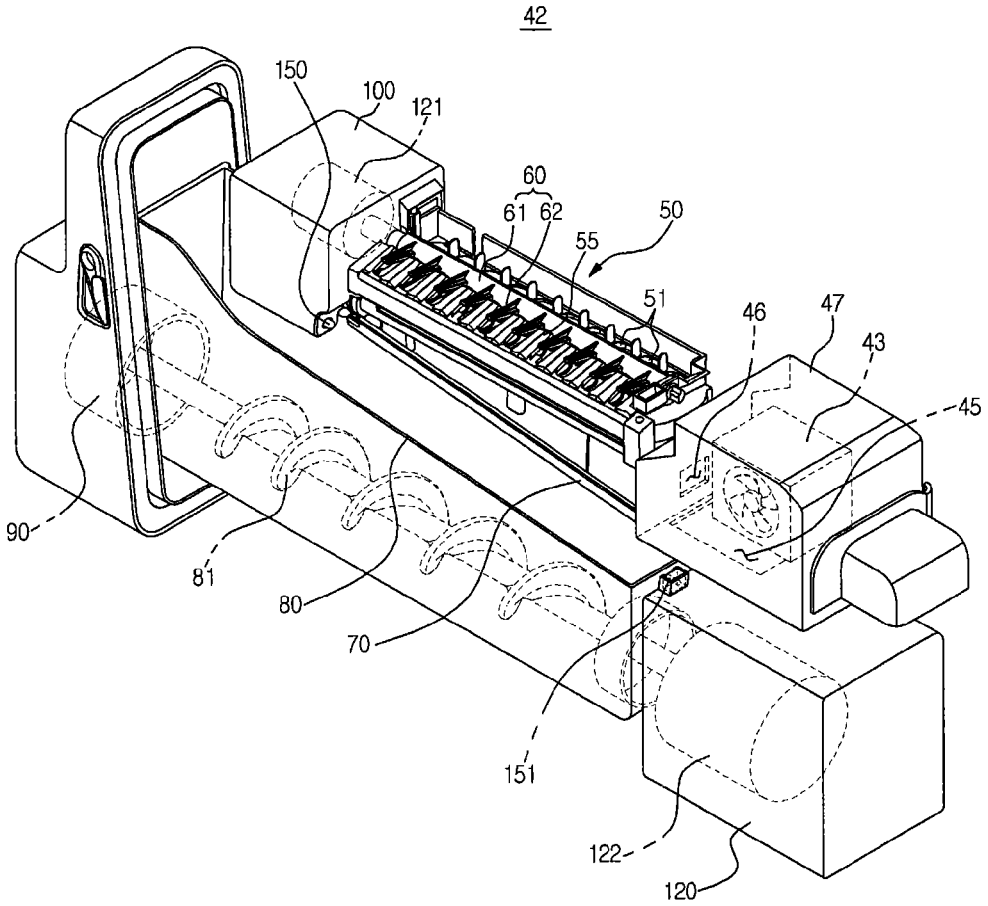
FIG. 3 is a perspective view illustrating an ice making apparatus shown in FIG. 2.
Figure 4:
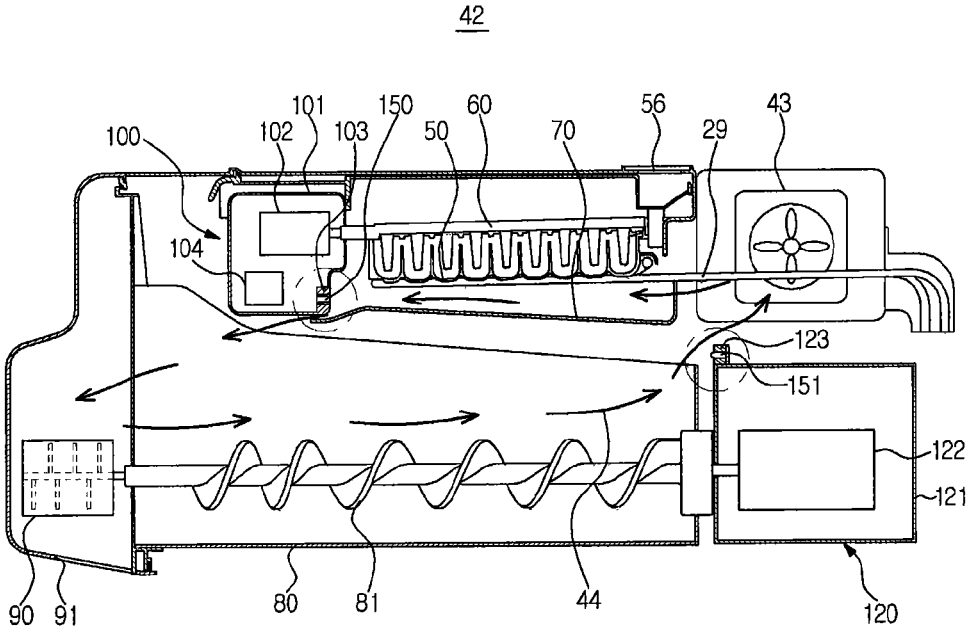
FIG. 4 is a sectional view illustrating the ice making apparatus shown in FIG. 2.
Figure 5:
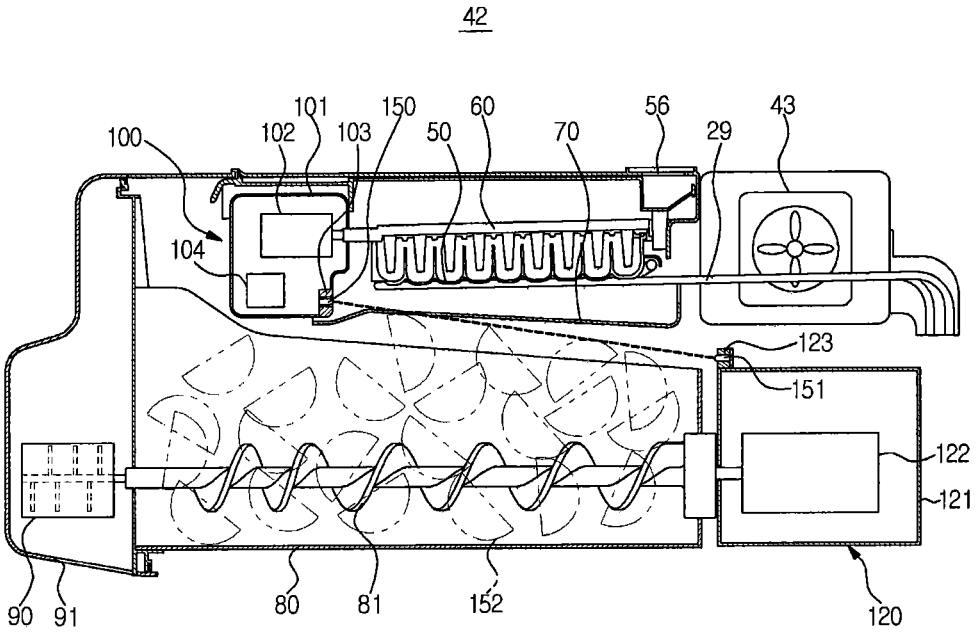
FIG. 5 is a view to explain an ice level sensing process of the ice making apparatus shown in FIG. 2.
Figure 6:
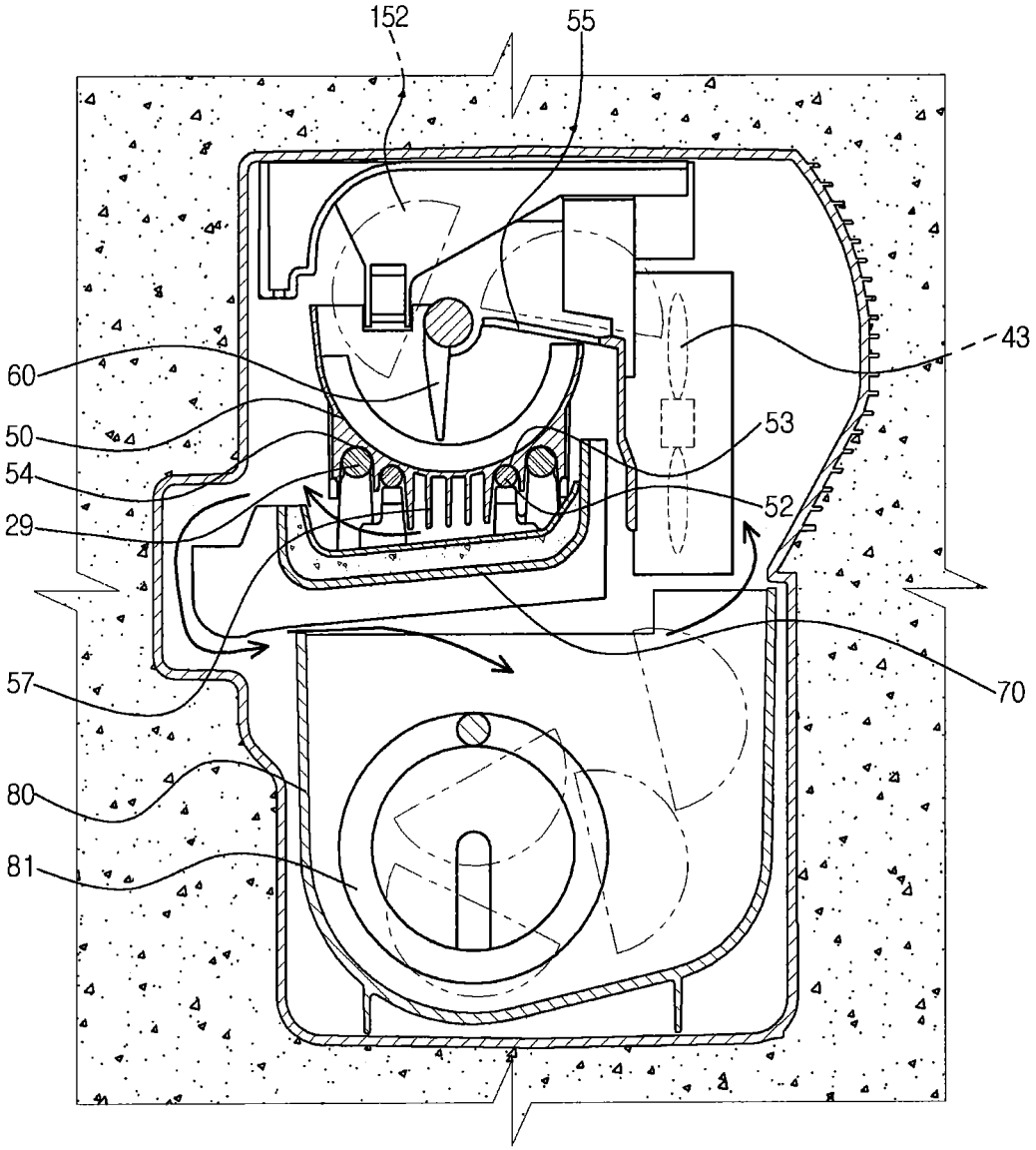
FIG. 6 is a sectional view illustrating an ice making chamber in which the ice making apparatus of FIG. 2 is installed.

FIG. 3 is a perspective view illustrating the ice making apparatus shown in FIG. 2. FIG. 4 is a sectional view illustrating the ice making apparatus shown in FIG. 2. FIG. 5 is a view to explain an ice level sensing process of the ice making apparatus shown in FIG. 2. FIG. 6 is a sectional view illustrating the ice making chamber in which the ice making apparatus of FIG. 2 is installed.

In FIGS. 5 and 6, reference numeral "152" refers to ice cubes. Dotted lines in FIG. 5 refer to a straight optical path between the emitter 150 and the receiver 151.

Hereinafter, the exemplary embodiment of the present invention will be further described with reference to FIGS. 3 to 6. The ice making apparatus 42 includes an ice making tray 50, an ejector 60, an ice bin 80, an auger 81, an ice making chamber fan 43, a first drive unit 100, and a second drive unit 120.

The ice making tray 50 serves as a container in which ice cubes are made, and is opened at an upper face thereof to supply water. The ice making tray 50 has a plurality of ice making grooves 51 formed in a substantially semicircular shape in section.

The ice making tray 50 is formed, at one side thereof, with a water supply portion 56 to supply the ice making grooves 51 with water.

The ice making tray 50 is slantingly provided with a plurality of sliders 55 so that the ice cube made in the ice making tray 50 are de-iced and slide downward. The sliders 55 are formed to be longitudinally spaced apart from one another by a predetermined clearance.

The ice making tray 50 may be made of a metal material having high heat conductivity to directly cool water received in the ice making grooves 51. The ice making tray 50 is formed, at opposite sides of a lower portion thereof, with ice making refrigerant pipe seating grooves 54 so as to come into contact with the ice making refrigerant pipe 29 which passes via the ice making chamber 40.

In addition, the ice making tray 50 is formed, at a central area of the lower portion thereof, with a plurality of heat exchange ribs 57 which protrude from the lower portion thereof. Due to such a configuration, since the ice making tray 50 itself absorbs evaporation heat of refrigerant, direct cooling type ice making can be achieved, thereby enabling ice cubes to be rapidly made.

Meanwhile, since each of the heat exchange ribs 57 formed at the ice making tray 50 has the lowest temperature in the ice making chamber 40, frost tends to be deposited on the heat exchange rib 57, compared with other ice making devices of the ice making chamber 40. That is, the heat exchange rib 57 serves as a frost depositing member to prevent frost from being deposited on other devices or regions by inducing frost deposition on the heat exchange rib 57 itself.

Also, deicing heater seating grooves 53 are formed between each ice making refrigerant pipe seating groove 54 and the corresponding heat exchange rib 57 so as to seat deicing heaters 52, respectively. The deicing heaters 52 allow ice cubes to be easily separated by application of heat to the ice making tray 50 during separation of ice cubes made in the ice making tray 50 from the ice making tray 50.

Furthermore, a drain duct 70 having a plate shape is provided beneath the ice making tray 50 to discharge water produced as frost deposited on the ice making tray 50 thaws. The drain duct 70 is arranged to be slightly spaced apart from the lower portion of the ice making tray 50 so that a portion of a cold air circulation passage 44 is defined between the ice making tray 50 and the drain duct 70.

Meanwhile, the ejector 60 serves to separate and discharge ice cubes from the ice making tray 50, and includes an ejector rotational shaft 61 disposed along a longitudinal direction at a central area of the ice making tray 50 and a plurality of ejector fins 62 which protrude toward the ice making grooves 51 from the ejector rotational shaft 61.

The ejector rotational shaft 61 rotates through provision of rotational force from the first drive unit 100 described below. In this case, each of the ejector fins 62 is advanced, at an end thereof, along an inner periphery of the corresponding ice making groove 51 so that ice cubes made in the ice making groove 51 are pushed and discharged from the ice making groove 51. In the exemplary embodiment of the present invention, the first drive unit 100 is arranged at the front of the ice making tray 50.

The ice bin 80 has a substantially box shaped opening at a upper face thereof to receive and store ice cubes discharged from the ice making tray 50 by the ejector 60, and is provided beneath the ice making tray 50.

The ice bin 80 is provided, at one side thereof, with an ice crusher 90 to finely crush ice cubes stored in the ice bin 80, and the ice crusher 90 is formed, at a lower side thereof, with a discharge port 91 communicating with the discharge path 34 (see FIG. 2) of the dispenser 30 so as to discharge the crushed ice cubes to the dispenser 30 (see FIG. 2).

Also, the ice bin 80 is arranged with the auger 81 to move ice cubes stored in the ice bin 80 toward the ice crusher 90. Although described below, the auger 81 rotates through provision of rotational force from the second drive unit 120 disposed at the rear of the ice bin 80 to move ice cubes forward.

The ice making chamber fan (or blast fan) 43 is used to circulate cold air in the ice making chamber 40 and defines the cold air circulation passage 44. The ice making chamber fan 43 is surrounded by an ice making chamber fan case 47 which is formed at a lower portion thereof with an inlet 45 while being formed at the front thereof with an outlet 46, such that cold air is suctioned from the lower portion of the ice making chamber fan case 47 and is discharged to the front of the ice making chamber fan case 47.

As shown in FIG. 4, the discharged cold air passes between the ice making tray 50 and the drain duct 70 and flows forward to reach up to the ice crusher 90, and then flows rearward again.

Also, as shown in FIG. 6, cold air flows forward between the ice making tray 50 and the drain duct 70 and in the course of flow the cold air simultaneously flows toward the ice bin 80 positioned beneath the ice making tray 50, thereby enabling the ice making chamber 40 to be cooled in three dimensions.

Although described below, the second drive unit 120 is positioned immediately beneath the ice making chamber fan 43. Accordingly, since air relatively and forcibly flows around the second drive unit 120, deposition of and growth in frost and fog may be prevented around the second drive unit 120.

The first drive unit 100 serves as a device to provide the ejector 60 with rotational force and rotate the ejector 60. The first drive unit 100 may include a controller 104 to control processes such as water supply, ice making, deicing, ice level sensing and the like. The controller 104 may include a heating element to radiate heat.

The first drive unit 100 includes a first motor 102 to generate rotational force, a first housing 101, and a first optical sensor receiving portion 103.

The first motor 102 serves as a device to convert electric energy into mechanical energy through electromagnetic induction, and generates rotational force so as to transfer the rotational force to the ejector rotational shaft 61.

The first housing 101 is formed in a substantially box shape to accommodate the first motor 102 and the controller 104.

The first optical sensor receiving portion 103 is provided to install the emitter 150 or the receiver 151, and this will be described in detail below.

The second drive unit 120 includes a second motor 122 to generate rotational force, a second housing 121, and a second optical sensor receiving portion 123.

The second motor 122 serves as a device to convert electric energy into mechanical energy through electromagnetic induction, and generates rotational force so as to transfer the rotational force to the auger 81.

The second housing 121 is formed in a substantially box shape to accommodate the second motor 122.

The second optical sensor receiving portion 123 is provided to install the emitter 150 or the receiver 151, similar to the first optical sensor receiving portion 103. This will be described in detail below.

The first and second motors 102 and 122 simultaneously radiate heat in the course of generating rotational force. Accordingly, the first and second drive units 100 and 120 correspond to relatively high temperature parts in the ice making chamber 40.

Meanwhile, the ice making apparatus 42 according to the exemplary embodiment of the present invention further includes optical sensors 150 and 151 to sense the ice level of the ice bin 80. The optical sensors 150 and 151 are comprised of the emitter 150 to output optical signals and the receiver 151 to receive the optical signals output from the emitter 150.

The emitter 150 and the receiver 151 are installed at the ice making chamber 40 so that the straight optical path therebetween substantially corresponds to a height when the ice bin 80 is fully filled with ice cubes. In particular, the emitter 150 and the receiver 151 are respectively installed at the first and second drive units 100 and 120, which are relatively the high temperature parts in the ice making chamber 40, so as to prevent the optical signals from being erroneously sensed by shutoff or distortion due to fog and frost.

Although showing that the emitter 150 is installed at the first drive unit 100 and the receiver 151 is installed at the second drive unit 120 in the drawings, it is natural that the emitter 150 may be installed at the second drive unit 120 and the receiver 151 may be installed at the first drive unit 100.

Meanwhile, since the emitter 150 and the receiver 151 are disposed to face each other so that the straight optical path may be formed therebetween, the emitter 150 is installed at a rear lower portion of the first drive unit 100 whereas the receiver 151 is installed at a front upper portion of the second drive unit 120.

Furthermore, the emitter 150 and the receiver 151 may be installed in a diagonal direction to enlarge or increase a sensing range.

For one example, when the emitter 150 is installed at one side in a width direction of the rear lower portion of the first drive unit 100, the receiver 151 may be installed at the other side in a width direction of the front upper portion of the second drive unit 120.

Here, the emitter 150 may be installed to be disposed on an inner surface of the first housing 101 so as to easily receive heat from the first motor 102 and the controller 104 by convection. The receiver 151 may be installed to be disposed on a surface of the second housing 121 so as to be positioned on the cold air circulation passage 44 and prevent growth in fog and frost by forcible flow of cold air.

However, the exemplary embodiment of the present invention is not limited thereto. Accordingly, the emitter 150 and the receiver 151 may be respectively installed at parts to further prevent growth in fog and frost among the inner surfaces, the surfaces, or the surface and inner surface of the respective first and second housing 101 and 121, generally considering effect of heat transfer by convection and effect by circulation flow of cold air.

Figure 7:
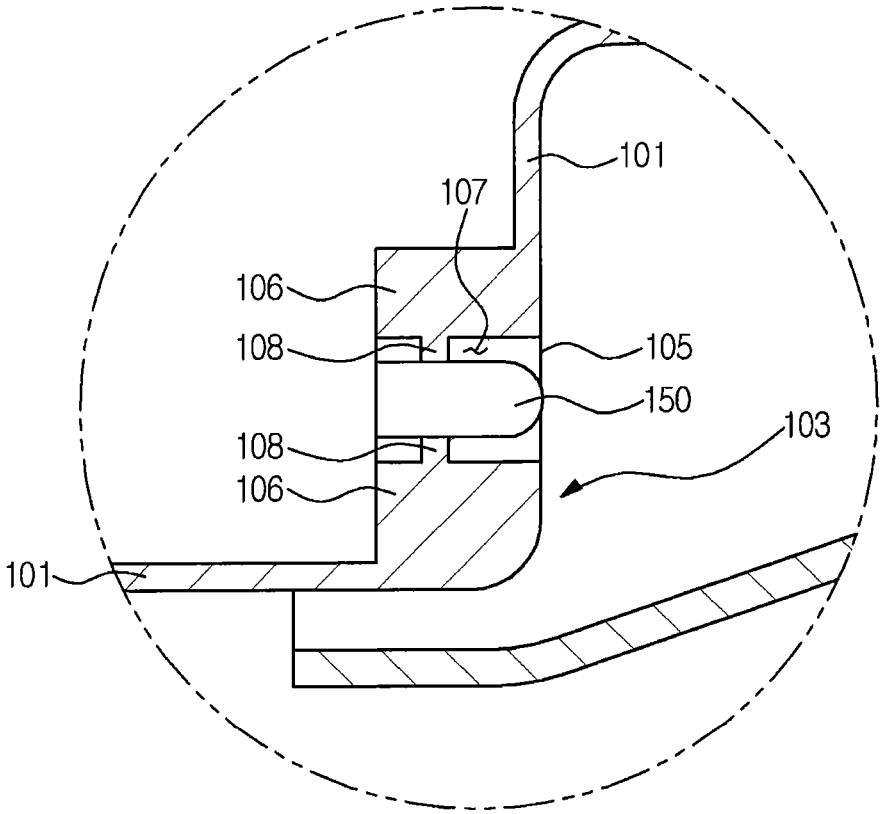
FIG. 7 is an enlarged view illustrating a first optical sensor receiving portion shown in FIG. 4.
Figure 8:
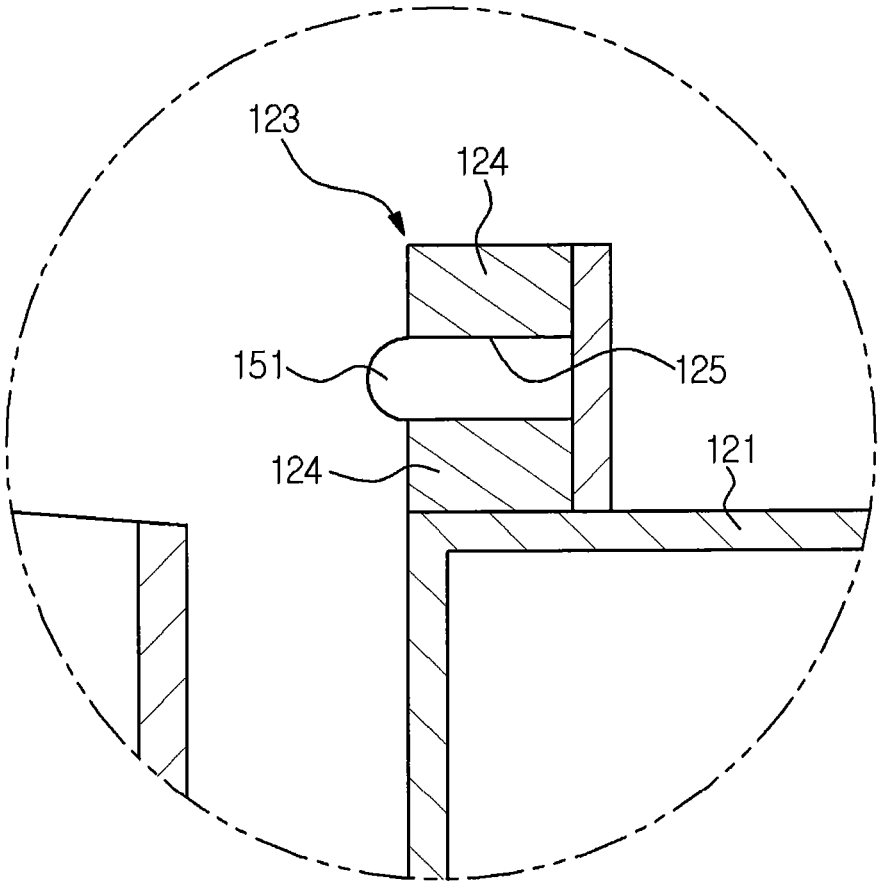
FIG. 8 is an enlarged view illustrating a second optical sensor receiving portion shown in FIG. 4.

FIG. 7 is an enlarged view illustrating the first optical sensor receiving portion shown in FIG. 4. FIG. 8 is an enlarged view illustrating the second optical sensor receiving portion shown in FIG. 4.

The first and second optical sensor receiving portions 103 and 123 will be described below with referenced to FIGS. 7 and 8.

The first and second optical sensor receiving portions 103 and 123 may be provided in various configurations. However, in the exemplary embodiment of the present invention, the first optical sensor receiving portion 103 is provided at a surface of the first housing 101 and includes a first socket portion 106 and a first optical sensor receiving space 107.

The first socket portion 106 protrudes from an inner side surface of the first housing 101 while being formed with the first optical sensor receiving space 107 therein.

Although the emitter 150 is installed at the first optical sensor receiving space 107 in the exemplary embodiment of the present invention as described above, the receiver 151 may be installed at the first optical sensor receiving space 107.

Here, the first optical sensor receiving portion 103 further includes protrusions 108 which protrude toward the first optical sensor receiving space 107 from opposite inner side surfaces of the first socket portion 106.

The protrusions 108 support the emitter 150 or the receiver 151 accommodated at the first optical sensor receiving space 107 and simultaneously minimize a contact area between the emitter 150 or receiver 151 and the first housing 101 so as to allow minimum heat to be transferred through conduction.

This is because the first housing 101 has, at an inner portion thereof, a high temperature due to heat generated from the first motor 102 and the controller 104, but the first housing 101 itself may have a low temperature due to effects of exterior cold air.

Accordingly, in accordance with such a configuration of the protrusions 108, the emitter 150 or receiver 151 installed at the first optical sensor receiving portion 103 may minimize transfer of heat to the first housing 101.

Meanwhile, the first housing 101 is formed, at one surface thereof, with an opening portion 105 so that the emitter 150 or receiver 151 installed at the first optical sensor receiving portion 103 is exposed outside the first housing 101.

The second optical sensor receiving portion 123 is provided at the surface of the second housing 121 and includes a second socket portion 124 and a second optical sensor receiving space 125.

The second socket portion 124 protrudes from an outer side surface of the second housing 121 while being formed with the second optical sensor receiving space 125 therein.

The second optical sensor receiving space 125 accommodates the emitter 150 or the receiver 151.

Figure 9:
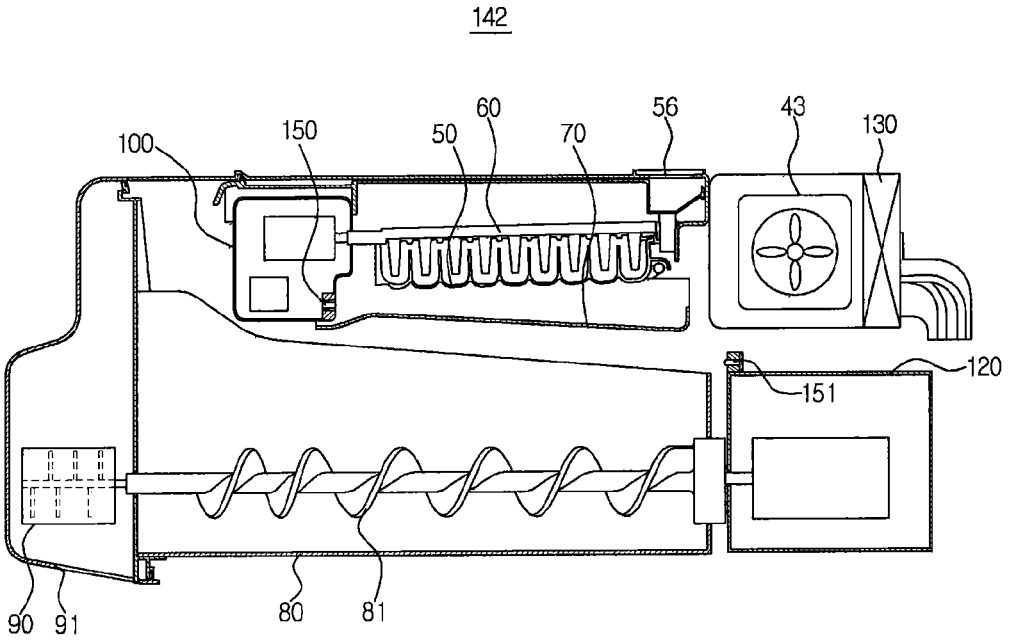
FIG. 9 is a sectional view illustrating an ice making apparatus according to another exemplary embodiment of the present invention.

FIG. 9 is a sectional view illustrating an ice making apparatus according to another exemplary embodiment of the present invention. Hereinafter, like reference numerals will refer to like elements and no description will be given with respect to the same configuration as the previous embodiment in another exemplary embodiment of the present invention.

Referring to FIG. 9, the ice making apparatus 142 and the refrigerator including the same according to another exemplary embodiment of the present invention is arranged with a heat exchanger 130 for the ice making chamber only, instead of the refrigerant pipe to directly supply cold air coming into contact with the ice making tray 50. That is, the ice making apparatus 142 has a configuration of an indirect cooling type using the heat exchanger 130.

In spite of such a configuration, the emitter 150 may be installed at the first drive unit 100 and the receiver 151 may be installed at the second drive unit 120, in order to prevent error sensing of the emitter 150 and receiver 151 due to fog and frost. Of course, the emitter 150 and the receiver 151 may also be reversely installed.

In this case, the heat exchanger 130 for the ice making chamber only serves as a frost depositing member to prevent frost from being deposited on other devices or regions by inducing frost deposition on the heat exchanger 130 itself.

Figure 10:
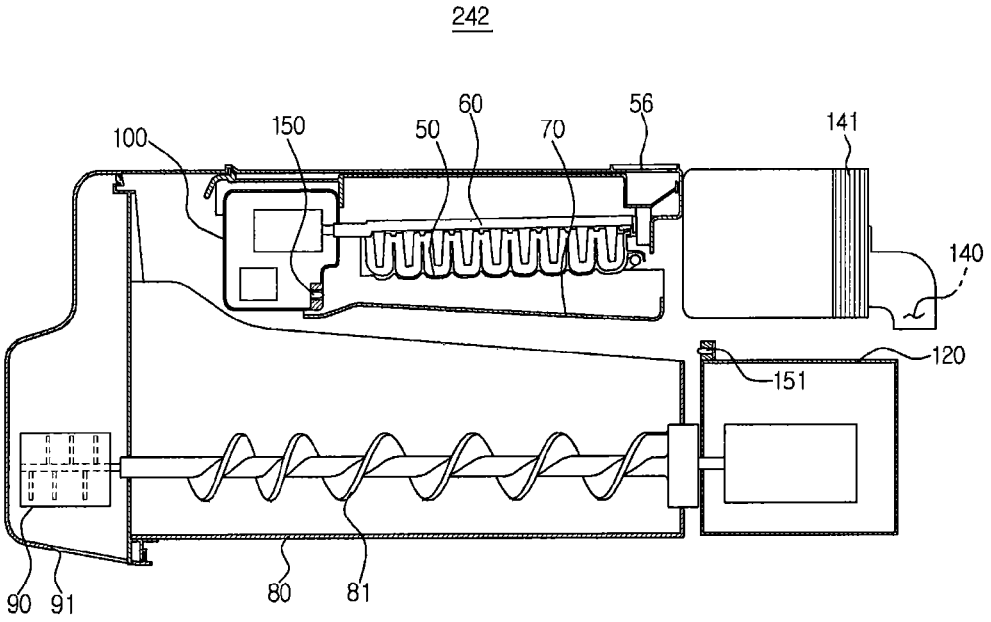
FIG. 10 is a sectional view illustrating an ice making apparatus according to yet another exemplary embodiment of the present invention.

FIG. 10 is a sectional view illustrating an ice making apparatus according to yet another exemplary embodiment of the present invention. Hereinafter, like reference numerals will refer to like elements and no description will be given with respect to the same configuration as the previous embodiment in this exemplary embodiment of the present invention.

Referring to FIG. 10, the ice making apparatus 242 and the refrigerator including the same according to yet another exemplary embodiment of the present invention includes an ice making chamber cold air supply duct 140 to draw cold air from another storage chamber except for the ice making chamber.

Cold air introduced through the ice making chamber cold air supply duct 140 flows out into another storage chamber again through a separate ice making chamber cold air discharge duct (not shown), thereby enabling circulation.

The emitter 150 may be installed at the first drive unit 100 and the receiver 151 may be installed at the second drive unit 120, in order to prevent error sensing of the emitter 150 and receiver 151 due to fog and frost. Of course, the emitter 150 and the receiver 151 may also be reversely installed.

The ice making apparatus 242 may function as a frost depositing member and include plates 141 for frost deposition only.

As is apparent from the above description, since a conventional optical sensor heater is unnecessary, the ice making apparatus and the refrigerator including the same according to the exemplary embodiments of the present invention may have the following various effects.

First, production costs of products are reduced.

Second, control logic to control the optical sensor heater is unnecessary.

Third, since there is no fault related to the optical sensor heater, product reliability is improved.

Fourth, since there is no energy consumption due to the optical sensor heater, power consumption is reduced.

Fifth, space efficiency in the ice making chamber is improved by a compact ice level sensing structure.

Also, in accordance with the exemplary embodiments of the present invention, since the emitter and the receiver which constitute the optical sensors are installed at the first and second drive units of the ice making apparatus instead of a separate structure, a separate additional process for assembly of the optical sensors is unnecessary, thereby improving ease of assembly and facilitating mass production.

The example embodiments of the refrigerator which include one or more controllers and one or more optical sensors, may use one or more processors, which may include a microprocessor, central processing unit (CPU), digital signal processor (DSP), or application-specific integrated circuit (ASIC), as well as portions or combinations of these and other processing devices.

The disclosure herein has provided example embodiments of a refrigerator which includes an optical sensor to sense whether ice cubes stored in an ice bin are at a full ice level without the requiring a conventional optical sensor heater for prevention of fog and/or frost. However the disclosure is not limited to particular embodiments described herein. For example, the first housing unit and second housing unit have been described above as being box-shaped, but the first housing unit and second housing unit may be another shape, so long as the shape of the housing unit does not negatively affect the operation of the refrigerator and/or optical sensor.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

an ice making tray in which ice cubes are made;

an ejector to discharge the ice cubes from the ice making tray;

an ice bin to store the ice cubes discharged by the ejector;

an auger to move the ice cubes in the ice bin;

a first drive unit to provide the ejector with rotational force;

a second drive unit to provide the auger with rotational force;

an emitter to output an optical signal to sense whether the ice cubes in the ice bin are at a full ice level; and a receiver to receive the optical signal output from the emitter, wherein:

any one of the emitter and the receiver is installed at the first drive unit; and the other one is installed at the second drive unit.

2. The refrigerator according to claim 1, wherein:

the first drive unit is arranged forward of the ice making tray; and the second drive unit is arranged rearward of the ice bin.

3. The refrigerator according to claim 2, wherein:

any one of the emitter and the receiver is installed at a rear lower portion of the first drive unit; and the other one is installed at a front upper portion of the second drive unit.

4. The refrigerator according to claim 1, wherein the first drive unit comprises:

a first motor to generate rotational force;

a first housing to accommodate the first motor; and a first optical sensor receiving portion arranged on an inner surface of the first housing to install the emitter or the receiver.

5. The refrigerator according to claim 4, wherein the first drive unit further comprises a controller which is accommodated at the first housing to control ice making processes.

6. The refrigerator according to claim 4, wherein the first housing is formed, at one surface thereof, with an opening portion so that the emitter or the receiver installed at the first optical sensor receiving portion is exposed to the outside.

7. The refrigerator according to claim 4, wherein the first optical sensor receiving portion comprises:

a first socket portion which protrudes from an inner side surface of the first housing; and a first optical sensor receiving space formed within the first socket portion.

8. The refrigerator according to claim 7, wherein the first optical sensor receiving portion further comprises protrusions which protrude from opposite inner side surfaces of the first socket portion to support the emitter or the receiver.

9. The refrigerator according to claim 1, wherein the second drive unit comprises:

a second motor to generate rotational force;

a second housing to accommodate the second motor; and a second optical sensor receiving portion arranged on a surface of the second housing to install the emitter or the receiver.

10. The refrigerator according to claim 9, wherein the second optical sensor receiving portion comprises:

a second socket portion which protrudes from an outer side surface of the second housing; and a second optical sensor receiving space formed within the second socket portion.

11. The refrigerator according to claim 1, further comprising a blast fan to circulate cold air to define a circulation passage of cold air in an ice making chamber, wherein the emitter and the receiver are positioned on the circulation passage.

12. The refrigerator according to claim 11, further comprising a frost depositing member provided at the ice making chamber to induce frost deposition on the frost depositing member itself.

13. The refrigerator according to claim 12, further comprising a refrigerant pipe to allow at least a portion thereof to come into contact with the ice making tray to supply the ice making chamber with cold air, wherein the frost depositing member comprises heat exchange ribs which protrude from a lower portion of the ice making tray.

14. The refrigerator according to claim 12, wherein the frost depositing member comprises a heat exchanger provided at the ice making chamber to supply the ice making chamber with cold air.

15. The refrigerator according to claim 12, wherein the frost depositing member comprises frost depositing plates provided at the ice making chamber.

16. The refrigerator according to claim 1, further comprising:

a main body;

a storage chamber provided within the main body while being opened at a front face thereof; and an ice making chamber provided within the storage chamber.

17. The refrigerator according to claim 1, wherein:

the ejector includes a rotational shaft disposed along a longitudinal direction, and the first drive unit is arranged above the second drive unit such that an optical path between the emitter and receiver is inclined relative to the longitudinal direction.

18. The refrigerator according to claim 1, wherein:

the first drive unit includes a first motor which radiates heat when the first motor is operated to provide the rotational force to the ejector, one of the emitter and the receiver installed at the first drive unit receives the heat radiated by the first motor, the second drive unit includes a second motor which radiates heat when the second motor is operated to provide the rotational force to the auger, and the other one of the emitter and the receiver installed at the second drive unit receives the heat radiated by the second motor.

19. The refrigerator according to claim 1, wherein:

the first drive unit includes a first housing which houses a first motor and a controller, the first motor radiates heat when the first motor is operated, and provides the rotational force to the ejector via a first rotational shaft which protrudes from the first housing, the controller controls an ice making process, and includes a heating element to radiate heat, one of the emitter and the receiver is installed at an inner side surface of the first housing of the first drive unit and receives the heat radiated by the first motor and the controller.

20. The refrigerator according to claim 19, wherein:

the second drive unit includes a second housing which houses a second motor, the second motor radiates heat when the second motor is operated, and provides the rotational force to the auger via a second rotational shaft which protrudes from the second housing, one of the emitter and the receiver is installed at an outer surface of the second housing of the second drive unit and receives the heat radiated by the second motor.

21. The refrigerator according to claim 1, further comprising:

a drain duct disposed below the ice making tray, the drain duct being configured to discharge water produced as frost deposited on the ice making tray thaws; and an ice making chamber fan disposed above the second drive unit and on an opposite side of the ice making tray relative to the first drive unit, the ice making chamber fan being configured to circulate cold air which flows forward between the ice making tray and drain duct, and flows rearward in the ice bin back toward the ice making chamber fan, wherein:

the one of the emitter and the receiver installed at the second drive unit is positioned to receive the cold air which flows rearward in the ice bin back toward the ice making chamber fan so that growth in fog and frost on the one of the emitter and the receiver is prevented.

* * * * *